US008104210B2

(12) United States Patent
Müller

(10) Patent No.: US 8,104,210 B2
(45) Date of Patent: Jan. 31, 2012

(54) RIFLE BODY

(75) Inventor: Hans Georg Müller, St. Valentin (AT)

(73) Assignee: STEYR MANNLICHER Holding GmbH, Kleinraming (AT)

( * ) Notice: Subject to any disclaimer, the term of this patent is extended or adjusted under 35 U.S.C. 154(b) by 62 days.

(21) Appl. No.: 12/526,371

(22) PCT Filed: Nov. 29, 2007

(86) PCT No.: PCT/AT2007/000538

§ 371 (c)(1),
(2), (4) Date: Aug. 7, 2009

(87) PCT Pub. No.: WO2008/106697

PCT Pub. Date: Sep. 12, 2008

(65) Prior Publication Data

US 2010/0037504 A1 Feb. 18, 2010

(30) Foreign Application Priority Data

Mar. 2, 2007 (AT) ..... GM130/2007 U

(51) Int. Cl.
*F41A 3/66* (2006.01)

(52) U.S. Cl. ..... 42/85; 42/96; 42/106

(58) Field of Classification Search ..... 42/71.01, 42/72, 75.01, 106, 96, 74
See application file for complete search history.

(56) References Cited

U.S. PATENT DOCUMENTS

| | | | | |
|---|---|---|---|---|
| 3,153,295 | A * | 10/1964 | Allyn | 42/75.01 |
| 4,315,379 | A | 2/1982 | Lang | |
| 4,674,216 | A * | 6/1987 | Ruger et al. | 42/71.01 |
| 5,175,911 | A * | 1/1993 | Terrels et al. | 24/674 |
| 5,225,613 | A * | 7/1993 | Claridge | 42/74 |
| 5,333,404 | A * | 8/1994 | Lingyak | 42/72 |
| 5,343,650 | A * | 9/1994 | Swan | 42/117 |
| 5,778,590 | A * | 7/1998 | Browning et al. | 42/96 |
| 7,698,845 | B2 * | 4/2010 | Hochstrate et al. | 42/69.03 |
| 7,823,319 | B2 * | 11/2010 | Casas Salva | 42/96 |
| 2005/0279004 | A1 | 12/2005 | Woodmansee, III et al. | |
| 2006/0150466 | A1 * | 7/2006 | Hochstrate et al. | 42/69.03 |
| 2007/0028502 | A1 | 2/2007 | Woodmansee, III et al. | |
| 2008/0190005 | A1 | 8/2008 | Rohrauer | |

FOREIGN PATENT DOCUMENTS

| | | |
|---|---|---|
| GB | 191311681 | 1/1914 |
| WO | WO2007030843 | 3/2007 |

OTHER PUBLICATIONS

International Preliminary Report on Patentability issued Nov. 5, 2009 from related International Application No. PCT/AT2007/000538.

* cited by examiner

*Primary Examiner* — Benjamin P Lee
(74) *Attorney, Agent, or Firm* — Hoffmann & Baron, LLP

(57) ABSTRACT

Rifle body with a basic carrier for anchoring a stock and a barrel, wherein the base carrier is provided on at least one side with the first part of at least one snap fastener connection for detachably anchoring elements which are equipped with the second part of said snap fastener connection.

16 Claims, 1 Drawing Sheet

RIFLE BODY

This application is the U.S. National Phase of International Application No. PCT/AT2007/000538 filed on Nov. 29, 2007, which claims priority to Austrian Application No. GM 130/2007 filed on Mar. 2, 2007, the disclosures of which are incorporated herein by reference.

FIELD OF THE INVENTION

The present invention relates to a rifle body with a basic carrier for attachment of a stock and a barrel.

OBJECTS AND SUMMARY OF THE INVENTION

The objective of the invention is to simplify the fastening of cover parts and accessories to such a body. This objective is achieved according to the invention in that the basic carrier is provided on at least one side with the first part of at least one snap fastener for detachable attachment of elements provided with the second part of said snap fastener.

The invention is based on the recognition that snap fasteners known per se from the field of clothing may also be used in a surprisingly simple, practical way for the construction and extension of rifle bodies without losses with regard to safety. The use of conventional commercial snap fasteners allows considerable savings in manufacturing costs and it has been demonstrated that rifle accessories may also be simply and stably attached therewith.

According to a preferred embodiment of the invention, the rifle body comprises two elements in the form of side panels, which are in each case attached on one side of the basic carrier by means of at least two stated snap fasteners. This gives rise to a rifle body with side panels which may be fitted and exchanged extremely simply, quickly and reliably, such that any desired composite material constructions may be used for the basic carrier and the side panels, such as metal/metal, metal/plastics, plastics/plastics, plastics/wood, metal/wood, etc.

If the side panels are made from plastics, it is particularly favorable for the second parts of the snap fasteners to be partially embedded in the basic material, for example by encapsulation in plastics by injection moulding during manufacture.

It is particularly advantageous, according to a further feature of the invention, for the first part of the snap fastener to be joined to the basic carrier by riveting. Alternatively, the basic carrier may be made of plastics and the first part of the snap fastener may be partially embedded in the plastics. Both variants are very simple and inexpensive to produce.

In any case it is particularly favorable according to a further feature of the invention for the rifle body to comprise elements in the form of spare cartridge holders, sights or camouflaging means, which are attached detachably by means of the stated snap fastener(s).

BRIEF DESCRIPTION OF THE DRAWINGS

The invention will be explained in greater detail below with reference to an exemplary embodiment illustrated in the appended drawings.

DETAILED DESCRIPTION OF THE PREFERRED EMBODIMENTS

Figure 1:
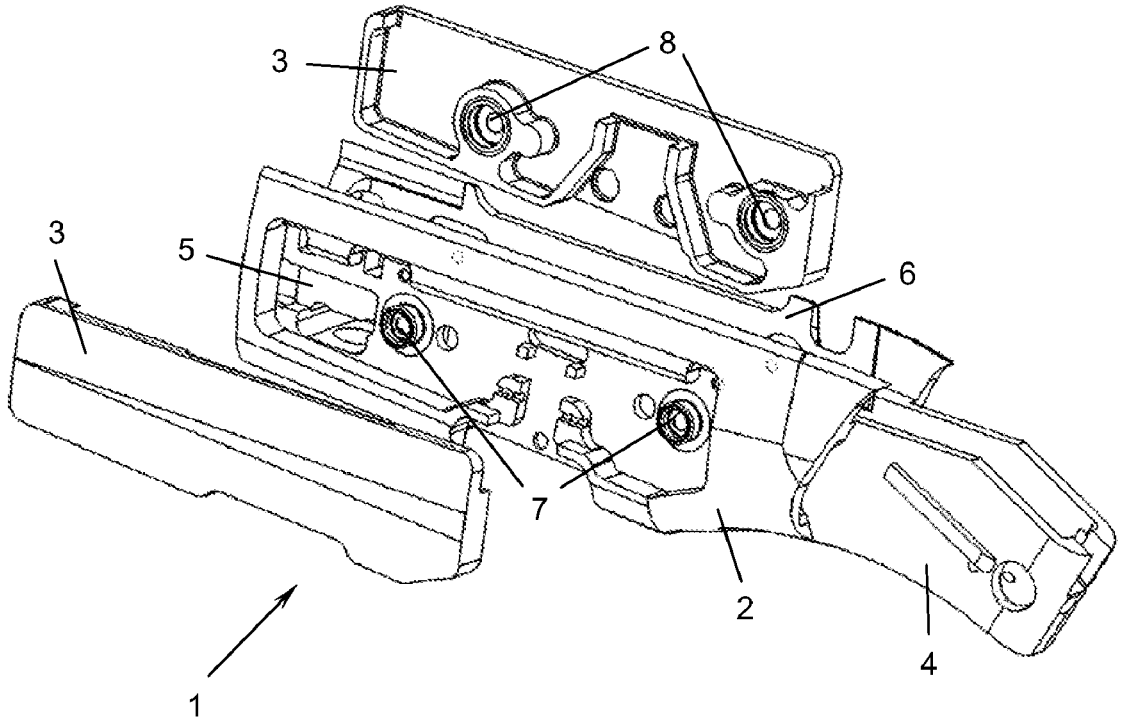
FIG. 1 of the drawings shows the rifle body of the invention in an exploded perspective view.

FIG. 1 shows an elongate rifle body 1, comprising a basic member 2 and two side panels 3. At its one end the basic carrier or member 2 comprises an attachment 4 for a stock and at its other end it comprises an attachment 5 for a barrel. In the example shown, the stock attachment 4 is an extension intended for introduction into a corresponding stock receptacle, and in the example shown, the barrel attachment 5 is a receptacle for the barrel root and/or a corresponding forestock. The basic carrier 2 additionally comprises a central receptacle 6 for a breech block and a trigger mechanism.

The side panels 3 cover the basic carrier 2 on its two sides and are in each case attached detachably to the basic carrier 2 by means of two snap fasteners 7, 8. Each snap fastener 7, 8 comprises a first part 7, which is provided on the basic carrier 2, and a second part 8 complementary thereto, which is provided on the respective side panel 3.

The snap fasteners 7, 8 are of a conventional type known in the art, such as are used for example in the clothing industry. As is known to a person skilled in the art, they each comprise a head, which may be snapped into an undercut socket or a socket provided with a spring ring.

The first and second parts 7, 8 are preferably made from metal. Preferably, the first part 7 in the form of a head is fastened to the basic carrier 2 by riveting and the second part 8 formed as a socket is partially embedded in the side panel 3 during moulding of the plastics of said side panel, for example by encapsulation by injection moulding.

Alternative embodiments are possible, according to which for example the part of the snap fastener 7, 8 formed as a head is arranged on the side panel and the part formed as a socket is arranged on the basic carrier; one or more than two snap fasteners 7, 8 are present, etc.

Instead of side panels 3, the snap fasteners 7, 8 may also be used to attach other types of elements to the basic carrier 2, for example spare cartridge holders, sights and/or camouflaging means. The present rifle body therefore also encompasses any variants in which such elements are attached detachably instead of or in addition to the side panels 3 by means of snap fasteners 7, 8.

The invention is not limited to the stated embodiments but instead encompasses all variants and modifications which fall within the scope of the appended claims.

What is claimed is:

1. A rifle body comprising:

a basic carrier including open sides exposing an attachment for a trigger mechanism, an attachment for a barrel at a first end and an attachment for a stock at a second opposite end, the basic carrier further including on one side, a first part of at least two snap fasteners; and at least one removably attachable element provided with at least two second mating parts of said snap fasteners, the removably attachable element being mounted on the side of the basic carrier between the first and second ends thereof to cover the exposed trigger mechanism, wherein at least one snap fastener is positioned between the first end and of the attachment for the trigger mechanism and a second snap fastener is positioned between the attachment for the trigger mechanism and the second end for removably securing the element to the basic carrier.

2. A rifle body according to claim 1, wherein the at least one element comprises two side panels, each side panel being attached on one side of the basic carrier.

3. A rifle body according to claim 2, wherein the side panels are made of plastics and the second part of the snap fasteners are partially embedded in the plastics.

4. A rifle body according to claim 1, wherein the first part of the snap fastener is connected to the basic carrier by riveting.

5. A rifle body according to claim 1, wherein the basic carrier is made of plastics and the first part of the snap fastener is partially embedded in the plastics.

6. A rifle body according to claim 1, wherein the at least one removably attachable elements comprises a spare cartridge holders, a sight or a camouflaging means.

7. A rifle body comprising:

a basic member having a first attachment portion at a fore end for a barrel and a second attachment portion at a rear end thereof for a stock; the basic member further including an exposed interior having a central receptacle for a breech block and trigger mechanism;

at least one removably attachable element removably mounted to a side of the basic member between the first attachment portion and the second attachment portion to provide a cover for the exposed interior of the basic member; and at least one snap fastener comprising a first part and a second part which detachably attach to each other, wherein the basic member includes the first part of the snap fastener and the removably attachable element includes the second part of the snap fastener so that the removably attachable element can be easily attached, detached and reattached to the basic member to expose and/or cover the interior of the basic member.

8. A rifle body according to claim 7, wherein the at least one element comprises two side panels, each side panel being attached on one side of the basic member by at least two snap fasteners, the at least two snap fasteners being positioned on one side of the basic member such that the fasteners are provided on opposite sides of a trigger mechanism receptacle.

9. A rifle body according to claim 8, wherein the side panels are made of plastics and the second part of the snap fasteners are partially embedded in the plastics.

10. A rifle body according to claim 7, wherein the first part of the snap fastener is connected to the basic member by riveting.

11. A rifle body according to claim 7, wherein the basic member is made of plastics and the first part of the snap fastener is partially embedded in the plastics.

12. A rifle body according to claim 7, wherein the removably attachable element comprises a spare cartridge holder, a sight or a camouflaging means.

13. A rifle body according to claim 7, wherein the first part of the snap fastener is in the form of a head and the second part of the snap fastener is in the form of a socket.

14. A rifle body according to claim 13, wherein the socket includes a spring ring.

15. A rifle body according to claim 1, wherein the first part of the snap fastener is in the form of a head and the second part of the snap fastener is in the form of a socket.

16. A rifle body according to claim 15, wherein the socket includes a spring ring.

* * * * *